US009886897B2

(12) United States Patent
Dan et al.

(10) Patent No.: US 9,886,897 B2
(45) Date of Patent: Feb. 6, 2018

(54) SIGNAL ADJUSTING CIRCUIT AND DISPLAY PANEL DRIVING CIRCUIT

(71) Applicants: Boe Technology Group Co., Ltd., Beijing (CN); CHONGQING BOE OPTOELECTRONICS TECHNOLOGY CO., LTD., Chongqing (CN)

(72) Inventors: Yi Dan, Beijing (CN); Shuai Chen, Beijing (CN); Hailong Wu, Beijing (CN); Yan Zhou, Beijing (CN); Dalong Mao, Beijing (CN); Taoliang Tang, Beijing (CN); Zhijian Qi, Bejing (CN)

(73) Assignees: BOE TECHNOLOGY GROUP CO., LTD., Beijing (CN); CHONGQING BOE OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 15/326,697

(22) PCT Filed: Jul. 5, 2016

(86) PCT No.: PCT/CN2016/088584
§ 371 (c)(1),
(2) Date: Jan. 17, 2017

(87) PCT Pub. No.: WO2017/067229
PCT Pub. Date: Apr. 27, 2017

(65) Prior Publication Data

US 2017/0278456 A1 Sep. 28, 2017

(30) Foreign Application Priority Data

Oct. 22, 2015 (CN) ..... 2015 1 0687062

(51) Int. Cl.
*G09G 3/36* (2006.01)
*G09G 3/3225* (2016.01)
*G09G 3/3266* (2016.01)

(52) U.S. Cl.
CPC ..... *G09G 3/3225* (2013.01); *G09G 3/3266* (2013.01); *G09G 3/3677* (2013.01);
(Continued)

(58) Field of Classification Search
None
See application file for complete search history.

(56) References Cited

U.S. PATENT DOCUMENTS 6,407,729 B1 * 6/2002 Moon ..... G09G 3/3648 345/205
7,164,405 B1 * 1/2007 Jeong ..... G09G 3/3688 345/94

(Continued)

FOREIGN PATENT DOCUMENTS

CN 1904996 1/2007
CN 1963896 5/2007

(Continued)

OTHER PUBLICATIONS

First Office Action from Chinese Patent Application No. 201510687062.9 dated Apr. 1, 2017.

(Continued)

*Primary Examiner* — Dorothy Harris
(74) *Attorney, Agent, or Firm* — Calfee, Halter & Griswold LLP

(57) ABSTRACT

A signal adjusting circuit and a display panel driving circuit are disclosed. The signal adjusting circuit includes an input terminal, a control terminal, an output terminal, a selection module and a delay module. The selection module is configured to selectively transfer an input signal received via the (Continued)

input terminal to the output terminal depending on an indication signal received via the control terminal. The delay module is configured to delay the input signal received from the selection module by an amount of time and transfer the delayed input signal to the output terminal. The display panel driving circuit includes one or more signal adjusting circuits to adjust periodic output enable pulses that enable outputting of gate scan pulses.

18 Claims, 5 Drawing Sheets

(52) U.S. Cl.
CPC . *G09G 2300/0426* (2013.01); *G09G 2310/06* (2013.01); *G09G 2310/08* (2013.01)

(56) References Cited

U.S. PATENT DOCUMENTS

2005/0052368 A1 3/2005 Kim
2005/0057480 A1* 3/2005 Liao ..... G09G 3/3677 345/98
2006/0114216 A1* 6/2006 Shim ..... G09G 3/3677 345/100
2006/0197758 A1 9/2006 Wang et al.
2007/0159441 A1* 7/2007 Yang ..... G09G 3/3677 345/99
2008/0030490 A1* 2/2008 Son ..... G09G 3/3648 345/205
2009/0219242 A1* 9/2009 Fuchigami ..... G09G 3/3648 345/100

FOREIGN PATENT DOCUMENTS

CN 201440221 U 4/2010
CN 102402957 A 4/2012
CN 102890923 A 1/2013
CN 103198803 A 7/2013
CN 103886844 A 6/2014
CN 105139826 12/2015
JP H1074061 3/1998
KR 1020070067956 A 6/2007

OTHER PUBLICATIONS

International Search Report for PCT/CN2016/088584 dated Sep. 21, 2016.

* cited by examiner

SIGNAL ADJUSTING CIRCUIT AND DISPLAY PANEL DRIVING CIRCUIT

CROSS-REFERENCE TO RELATED APPLICATIONS

The present application is the U.S. national phase entry of PCT/CN2016/088584, with an international filing date of Jul. 5, 2016, which claims the benefit of Chinese Patent Application No. 201510687062.9, filed on Oct. 22, 2015, the entire disclosures of which are incorporated herein by reference.

TECHNICAL FIELD

The present disclosure relates to the field of display technologies, and specifically to a signal adjusting circuit and a display panel driving circuit.

BACKGROUND

In an active matrix type display such as a thin film transistor liquid crystal display (TFT-LCD), the gate driver is usually provided with a fan-out region where output terminals of the gate driver are connected to input terminals of the display panel via a plurality of wires distributed in a fan-shaped pattern, to provide gate scanning signals to the display panel.

FIG. 1 schematically illustrates an example of wirings in a fan-out region of a gate driver. As shown in the figure, in the fan-out region, a length of wiring in an edge area may be substantially different from that in a non-edge area (or referred to as a middle area). Specifically, the wirings in the edge area may be far longer than in the non-edge area. In practice, the wire has a resistance value and there usually exists a parasitic capacitor on a circuit path, which causes an RC delay effect. Hence, as compared with a gate scan pulse transmitted through the wiring in the non-edge area, a gate scan pulse transmitted through the wiring in the edge area may experience a large delay. This delay might cause deterioration of displayed images, for example, occurrence of a transverse block. This is undesirable for improvement of the display quality.

Therefore, there is a need for an improved mechanism to provide gate scan pulses for the display panel.

SUMMARY

It would be advantageous to provide a signal adjusting circuit and a display panel driving circuit to alleviate, mitigate or eliminate a relative delay between gate scan pulses provided to rows of pixel units of the display panel due to e.g. a difference of the length of the wirings in the fan-out region.

According to a first aspect of the present disclosure, a signal adjusting circuit is provided comprising: an input terminal for receiving an input signal; a control terminal for receiving an indication signal; an output terminal for outputting an adjusted input signal; a selection module; and a delay module. The selection module is connected to the input terminal, the control terminal, the output terminal and the delay module, and is operable to selectively transfer the input signal received via the input terminal to the output terminal or the delay module depending on the indication signal received via the control terminal. The delay module is connected to the selection module and the output terminal, and is operable to delay the input signal received from the selection module by an amount of time and transfer the delayed input signal to the output terminal.

In some embodiments, the selection module comprises: a comparator having a first internal input terminal connected to the control terminal, a second internal input terminal for receiving a reference level, and an internal output terminal; a first transistor having a gate connected to the internal output terminal, a first electrode connected to the input terminal, and a second electrode connected to the output terminal; and a second transistor having a gate connected to the internal output terminal, a first electrode connected to the delay module, and a second electrode connected to the input terminal. The first transistor is one of a P-type transistor and an N-type transistor, and the second transistor is of a type opposite to that of the first transistor.

In some embodiments, the comparator comprises an integrated operational amplifier.

In some embodiments, the delay module comprises an RC delay circuit.

In some embodiments, the delay module further comprises a waveform adjusting circuit connected in series with the RC delay circuit.

In some embodiments, the waveform adjusting circuit comprises an edge trigger or an even number of phase inverters.

In some embodiments, the circuit further comprises an output capacitor having a terminal connected to the output terminal and another terminal being grounded.

According to a second aspect of the present disclosure, a display panel driving circuit is provided comprising: one or more signal adjusting circuits as recited in the first aspect, the one or more signal adjusting circuits being cascaded together so that the output terminal of a preceding signal adjusting circuit is connected to the input terminal of a succeeding signal adjusting circuit; a timing control module for providing periodic output enable pulses to the input terminal of the first one of the one or more cascaded signal adjusting circuits, each of the output enable pulses being for enabling outputting of a respective gate scan pulse; and an indication signal generating module for providing the control terminal of each of the one or more cascaded signal adjusting circuits with a respective indication signal. Each of the one or more cascaded signal adjusting circuits is configured to selectively delay the output enable pulses received via its input terminal by a respective amount of time depending on the respective indication signal.

In some embodiments, the indication signal comprises within a frame period, a first phase indicating not to delay the output enable pulses, and a second phase indicating to delay the output enable pulses.

In some embodiments, the first phase corresponds to a phase in which gate lines connected to wirings in an edge area of a fan-out region of a gate driver are scanned, and wherein the second phase corresponds to a phase in which gate lines connected to wirings in a non-edge area of the fan-out region of the gate driver are scanned.

In some embodiments, the second phase of the indication signal for a succeeding signal adjusting circuit falls within the second phase of the indication signal for a preceding signal adjusting circuit so that a duration of the second phase of the indication signal for the succeeding signal adjusting circuit is smaller than a duration of the second phase of the indication signal for the preceding signal adjusting circuit.

In some embodiments, the timing control module and the indication signal generating module are integrated in a timing controller of the display panel.

The present disclosure is based on the concept of adjusting a relative delay between different gate scan pulses by adjusting the timing of the output enable pulses provided to the gate driver.

These and other aspects of the present invention will be apparent from and elucidated with reference to the embodiment(s) described hereinafter.

DETAILED DESCRIPTION

Embodiments of the present disclosure will be described in detail with reference to the accompanying drawings.

Figure 2A:
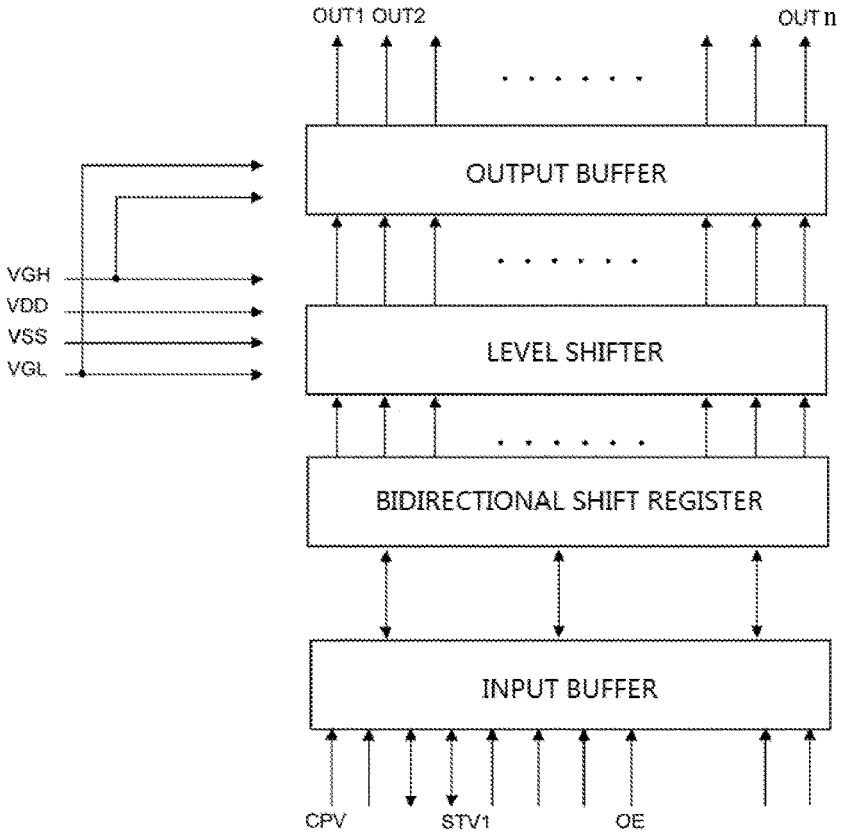
Fig. 2a (PRIOR ART)
FIG. 2*a* schematically illustrates a block diagram of a prior art gate driver.
Figure 2B:
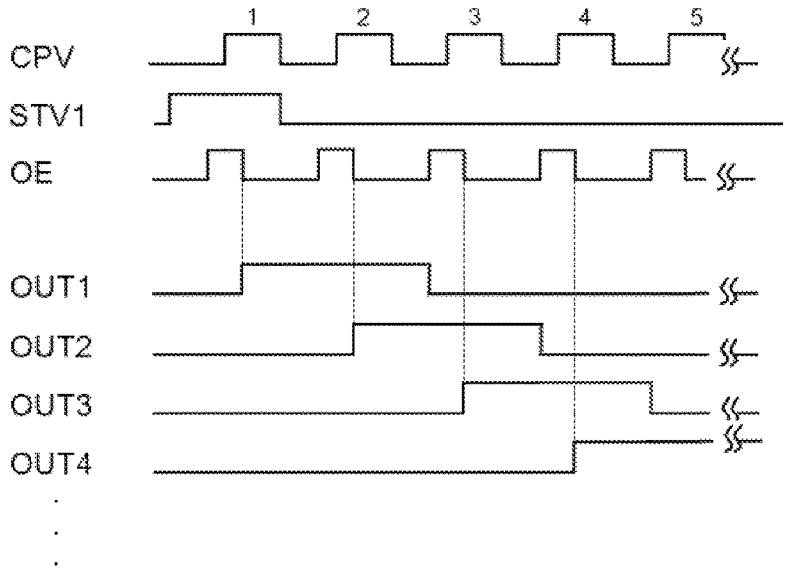
Fig. 2b (PRIOR ART)
FIG. 2*b* schematically illustrates an example of timing of output enable pulses and gate scan pulses of the gate driver as shown in FIG. 2*a;*
Figure 2C:
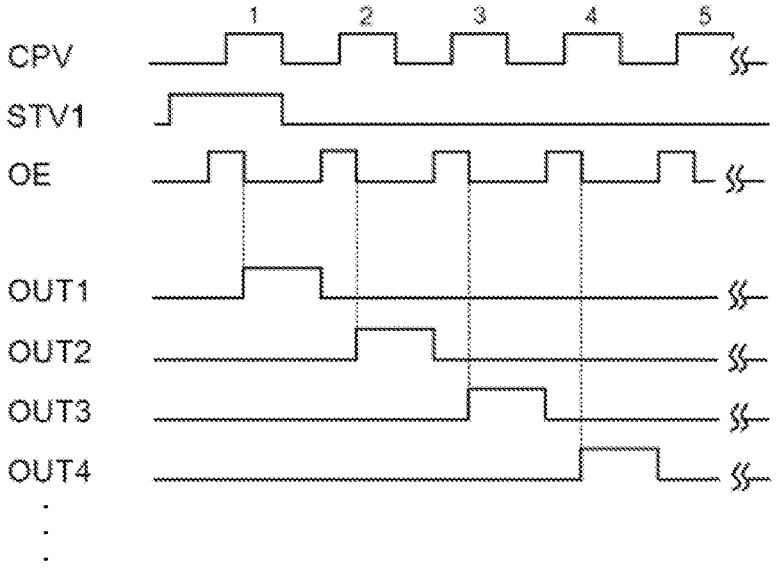
Fig. 2c (PRIOR ART)
FIG. 2*c* schematically illustrates another example of timing of output enable pulses and a gate scan pulses of the gate driver as shown in FIG. 2*a;*

Before elaborating embodiments of the present disclosure, reference may be made to FIGS. 2*a*-2*c* to provide better understanding of embodiments of the present disclosure.

Figure 1:
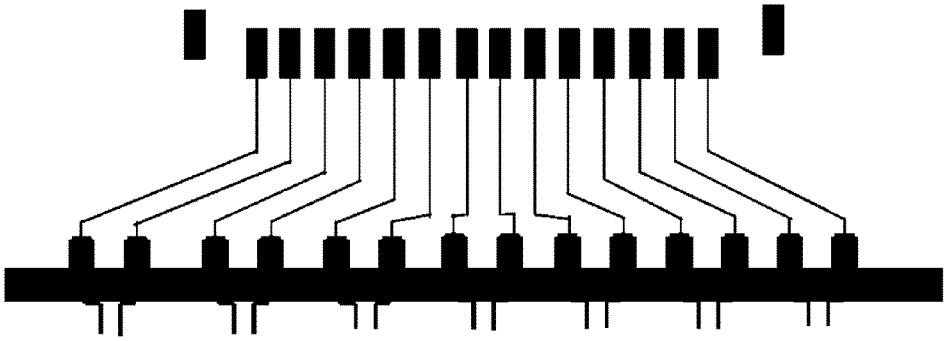
Fig. 1 (PRIOR ART)
FIG. 1 schematically illustrates an example of wirings in a fan-out region of a gate driver.

FIG. 2*a* schematically illustrates a block diagram of a prior art gate driver. As shown in the figure, the gate driver is in essence a shift register which sequentially outputs successive gate scan pulses at output terminals OUT1, OUT2, . . . OUTn under excitation of control signals including a shift clock input CPV, a start pulse input STV1 and an output enable pulse OE and power supply signals including a high level VGH, a low level VGL, a power supply voltage VDD and a ground voltage VSS. These gate scan pulses would be provided to gate lines of a display panel for example via the wirings in the fan-out region as shown in FIG. 1, so that each row of pixel units of the display panel are sequentially activated and provided with display data. In this way, display of an image is achieved.

FIGS. 2*b* and 2*c* respectively illustrate different examples of the timing of output enable pulses OE and gate scan pulses OUT1, OUT2, OUT3, OUT4 . . . of the gate driver as shown in FIG. 2*a*. As indicated by the dotted lines in the figures, an edge (shown as a falling edge in the figures) of each output enable pulse OE can enable outputting of a respective gate scan pulse. As such, a relative delay between different gate scan pulses OUTx (x=1, 2, 3, 4 . . . ) may be adjusted by adjusting the timing of the output enable pulses OE that are provided to the gate driver. The structure and operation of the gate driver is known in the art, and therefore will not be described in detail here.

Figure 3:
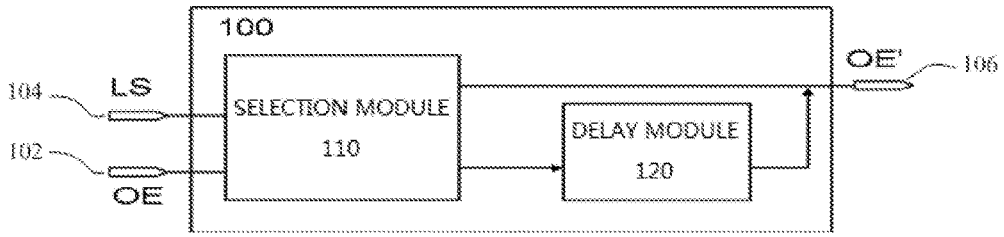
FIG. 3 schematically illustrates a block diagram of a signal adjusting circuit that can be used to adjust periodical output enable pulses of a gate driver, according to an embodiment of the present disclosure.

FIG. 3 schematically illustrates a block diagram of a signal adjusting circuit 100 that can be used to adjust periodical output enable pulses of a gate driver, according to an embodiment of the present disclosure. As shown in the figure, the signal adjusting circuit 100 includes an input terminal 102, a control terminal 104, an output terminal 106, a selection module 110 and a delay module 120.

The input terminal 102 receives an input signal (illustrated as an output enable pulse OE). The control terminal 104 receives an indication signal LS which indicates whether to adjust the input signal received via the input terminal. The output terminal 106 outputs the adjusted input signal (illustrated as an output enable pulse OE').

The selection module 110 is connected to the input terminal 102, the control terminal 104, the output terminal 106 and the delay module 102, and is operable to selectively transfer the input signal (i.e., the output enable pulse OE) to the output terminal 106 depending on the indication signal LS, for output or transfer to the delay module 120.

The delay module 120 is connected to the selection module 110 and the output terminal 106, and is operable to delay the input signal OE received from the selection module 110 by an amount of time and transfer the delayed input signal (i.e., the output enable pulse OE') to the output terminal 106 for output.

Thus, the input signal may be delayed depending on the indication signal LS. In an embodiment in which the input signal includes periodical output enable pulses OE, some of the output enable pulses OE may be delayed so that the gate scan pulses enabled by these output enable pulses OE are also delayed accordingly, thereby changing the relative delay between different gate scan pulses. In particular, in a context where the relative delay between the gate scan pulses is caused by the difference of the length of the wirings in the fan-out region of the gate driving circuit, it is possible to reduce or even substantially eliminate such a relative delay by delaying the gate scan pulses provided to the wirings in the middle area of the fan-out region by an amount of time while maintaining the timing of the gate scan pulses provided to the wirings in the edge area of the fan-out region.

Figure 4:
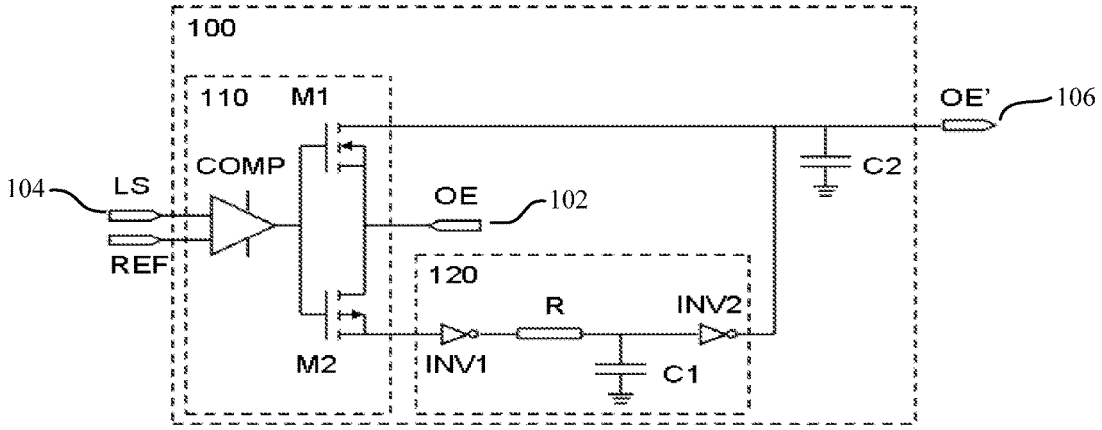
FIG. 4 schematically illustrates an equivalent circuit diagram of the signal adjusting circuit as shown in FIG. 3 according to an embodiment of the present disclosure.

FIG. 4 schematically illustrates an equivalent circuit diagram of a signal adjusting circuit 100 as shown in FIG. 3 according to an embodiment of the present disclosure.

As shown in the figure, the selection module 110 includes a comparator COMP, a first transistor M1 and a second transistor M2.

The comparator COMP may be a comparator formed by an integrated operational amplifier. The comparator COMP has a first internal input terminal connected to the control terminal 104, a second internal input terminal for receiving a reference level REF, and an internal output terminal.

The first transistor M1 has a gate connected to the internal output terminal, a first electrode connected to the input terminal 102, and a second electrode connected to the output terminal 106. The second transistor M2 has a gate connected to the internal output terminal, a first electrode connected to the delay module 120, and a second electrode connected to the input terminal 102. The first transistor M1 may be one of a P-type transistor and an N-type transistor, whereas the second transistor M2 is of a type opposite to that of the first transistor M1. In the illustrated example, the first transistor M1 is an N-type transistor and the second transistor M2 is a P-type transistor. In another example, the first transistor M1 may be a P-type transistor, and the second transistor M2 may be an N-type transistor. Furthermore, both the first transistor M1 and second transistor M2 may be a thin film transistor.

If the level of the indication signal LS is higher than the reference level REF (e.g., LS has a high level), the comparator COMP outputs a high level so that the first transistor M1 is turned on and transfers the output enable pulse OE received via the input terminal 102 directly to the output terminal 106 for output. If the level of the indication signal LS is lower than the reference level REF (e.g., LS has a low level), the comparator COMP outputs a low level so that the second transistor M2 is turned on and transfers the output enable pulse OE received via the input terminal 102 to the delay module 120.

The delay module 120 may include an RC delay circuit. The RC delay circuit includes a resistor R and a first capacitor C1. After passing through the RC delay circuit, the output enable pulse OE from the selection module 110 (specifically, the first electrode of the second transistor M2) is delayed by an amount of time. The delay time is determined by a resistance value of the resistor R and a capacitance value of the first capacitor C1. In addition, the delay module 120 may further include a waveform adjusting circuit connected in series with the RC delay circuit to perform waveform shaping for the signal having passed through the delay module 120 (e.g., to improve a slope of its edge). In some embodiments, the waveform adjusting circuit may include an edge trigger. Alternatively or additionally, the waveform adjusting circuit may include an even number of phase inverters. In the illustrated example, the waveform adjusting circuit includes a first phase inverter INV1 and a second phase inverter INV2, which shape the waveform of the output enable pulse OE before and after it passes through the RC delay circuit, respectively.

It will be appreciated that the RC delay circuit in FIG. 4 is only exemplary. In other embodiments, the delay module 120 may include any other suitable delay circuits such as a relay circuit based on a Schmitt trigger.

In addition, the signal adjusting circuit 100 may further include a second capacitor C2 which has a terminal connected to the output terminal and another terminal being grounded. The second capacitor C2 may provide filtering and voltage stabilization for the output enable pulse OE' to be output.

In the above description, the signal adjusting circuit 100 is described as adjusting the output enable pulse OE. However, the present disclosure is not so limited. The input signal of the signal adjusting circuit 100 may be any other suitable signals such as one or more pulses.

Figure 5:
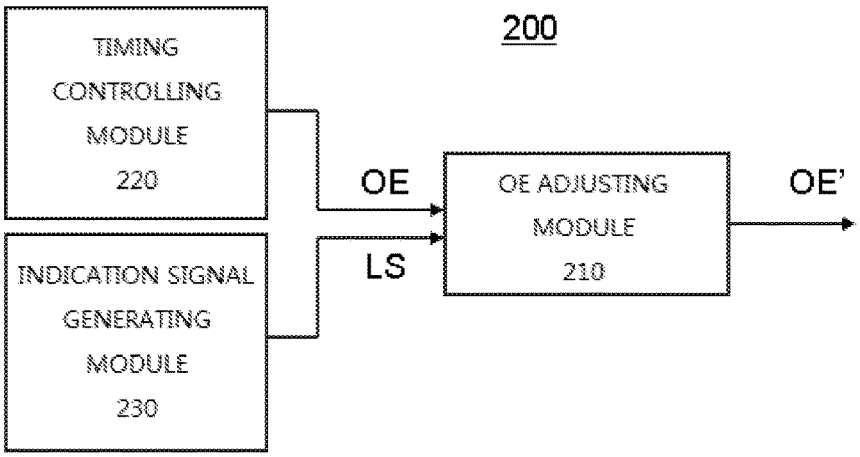
FIG. 5 schematically illustrates a display panel driving circuit according to an embodiment of the present disclosure.

FIG. 5 schematically illustrates a display panel driving circuit 200 according to an embodiment of the present disclosure. Examples of the display panel include a TFT-LCD display panel and an AMOLED display panel.

As shown in the figure, the driving circuit 200 includes an OE adjusting module 210, a timing controlling module 220 and an indication signal generating module 230.

The OE adjusting module 210 receives the periodical output enable pulses OE provided by the timing controlling module 220 and an indication signal LS provided by the indication signal generating module 230. Specifically, the OE adjusting module 210 may be implemented with the signal adjusting circuit 100 as shown in FIG. 4, which selectively delays the output enable pulses OE depending on the indication signal LS, thereby providing delayed output enable pulses OE' in a predetermined time period of a frame period.

The timing controlling module 220 is used to provide periodic output enable pulses OE that enable outputting of gate scan pulses. In an embodiment, the timing controlling module 220 may be a timing controller (TCON) in the display panel. As is known, the TCON may provide various control signals, including the output enable pulses OE for the gate driver.

The indication signal generating module 230 is used to provide an indication signal LS that indicates whether to delay the output enable pulses OE. In an embodiment in which the OE adjusting module 210 is the signal adjusting circuit 100 as described above, a high level of the indication signal LS indicates not to delay the output enable pulses OE, and a low level of the indication signal LS indicates to delay the output enable pulses OE. In particular, in a context where the relative delay between the gate scan pulses results from the difference of the length of the wirings in the fan-out region of the gate driver, the indication signal LS may include within a frame period a high-level first phase and a low-level second phase, wherein the first phase corresponds to a phase in which the gate lines connected to the wirings in the edge area of the fan-out region of the gate driver are scanned, and the second phase corresponds to a phase in which the gate lines connected to the wirings in the non-edge area of the fan-out region of the gate driver are scanned. Herein, "a gate line being scanned" means that the gate line is provided with a gate scan pulse.

It is to be noted that an active level of the indication level LS depends on the type of the first transistor M1 and the second transistor M2 in the signal adjusting circuit 100. In an embodiment in which the first transistor M1 is a P-type transistor and the second transistor M2 is an N-type transistor, a high level of the indication signal LS indicates to delay the output enable pulses OE, and a low level of the indication signal LS indicates not to delay the output enable pulses OE.

The driving circuit 200 may further include a gate driver (not shown) to generate the gate scan pulses based on the adjusted output enable pulses OE' from the OE adjusting module 210. Examples of the gate driver include the gate driver as shown in FIG. 2*a*.

Figure 6A:
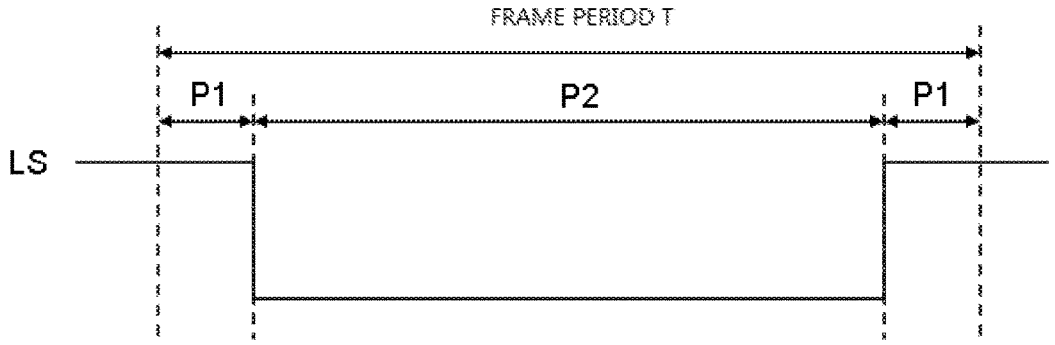
FIG. 6*a* schematically illustrates an example of an indication signal generated by the indication signal generating module as shown in FIG. 5.

FIG. 6*a* schematically illustrates an example of the indication signal LS generated by the indication signal generating module 230 in FIG. 5.

As shown in the figure, the indication signal LS in a frame period T can be divided into a first phase P1 and a second phase P2, wherein the first phase P1 corresponds to a phase in which the gate lines connected to the wirings in the edge area of the fan-out region of the gate driver are scanned, and the second phase P2 corresponds to a phase in which the gate lines connected to the wirings in the non-edge area of the fan-out region of the gate driver are scanned. In particular, the first phase P1 includes two portions respectively corresponding to both lateral edges of the fan-out region. In an embodiment, the two portions of the first phase P1 may occupy 0-10% and 90%-100% of the frame period T, respectively, and the second phase P2 may occupy 10%-90% of the frame period T. As described above, the first phase P1 may be a high level, indicating not to delay the output enable pulses OE, and the second phase P2 may be a low level, indicating to delay the output enable pulses OE.

In some embodiments, the indication signal generating module 230 in FIG. 5 may include a timer (not shown). The timer counts, e.g., from 0 to 65535, with a cycle equal to the frame period T. Within a time interval in which the timer counts from 0 to a first value (as represented by P1 on the left side of FIG. 6*a*), the indication signal generating module 230 outputs a high level. Within a time interval in which the timer counts from the first value to a second value (as represented by P2 in FIG. 6*a*), the indication signal generating module 230 outputs a low level. Within a time interval in which the timer counts from the second value to 65535 (as represented by P1 on the right side of FIG. 6*a*), the indication signal generating module 230 outputs a high level.

It should be appreciated that the timing of the indication signal LS is only used for purposes of illustration, not for limitation. In addition, the indication signal generating module 230 may be separate from the timing controller, or it may be integrated into the timing controller.

Figure 6B:
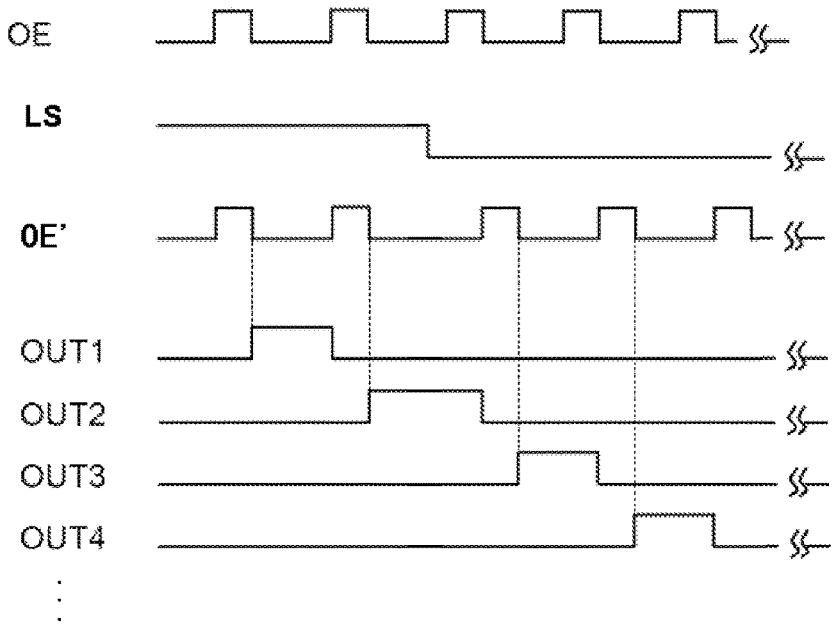
FIG. 6*b* schematically illustrates the timing of adjusted output enable pulses and corresponding gate scan pulses generated from original output enable pulses by a display panel driving circuit according to an embodiment of the present disclosure under excitation of the indication signal as shown in FIG. 6*a;*

FIG. 6*b* schematically illustrates the timing of adjusted output enable signals OE' and corresponding gate scan pulses OUT1, OUT2, OUT3, OUT4 . . . generated from original output enable pulses by a display panel driving circuit 200 according to an embodiment of the present disclosure under excitation of the indication signal LS as shown in FIG. 6*a*.

As shown in the figure, when the indication signal LS is a high level, the original output enable pulses OE is not delayed, and correspondingly, the gate scan pulses OUT1 and OUT2 (corresponding to the edge area of the fan-out region) are not delayed. When the indication signal LS is a low level, the original output enable pulses OE are delayed by an amount of time, and correspondingly, the gate scan pulses OUT3, OUT4 and subsequent several scanning pulses (corresponding to the non-edge area of the fan-out region) are also delayed by the amount of time.

Conversely, when the gate scan pulses are transmitted by respective wirings in the fan-out region, the wirings in the edge area of the fan-out region will cause larger delay to the gate scan pulses than the wirings in the non-edge area of the fan-out region. A total effect is that the relative delay between the gate scan pulses that are ultimately applied to the gate lines of the display panel is reduced or even eliminated.

In the above embodiments, the display panel driving circuit 200 is shown as having only one OE adjusting module 210. However, if the relative delay between the gate scan pulses caused by the wirings in the fan-out region is very large, two or more OE adjusting modules may be disposed to provide more precise control of the delay of the gate scan pulses. More specifically, two or more OE adjusting modules may be cascaded together so that the output terminal of a preceding OE adjusting module is connected to the input terminal of a succeeding OE adjusting module.

The timing control module may provide periodic output enable pulses OE to the OE adjusting module that is the first stage. The indication signal generating module may provide each of the OE adjusting modules with a respective indication signal to indicate to delay the output enable pulses OE in different phases of the frame period. Each OE adjusting module may selectively delay the output enable pulses received via its input terminal by an amount of time depending on the respective indication signal. In an embodiment, the delay time contributed by each OE adjusting module may or may not be equal.

Figure 7:
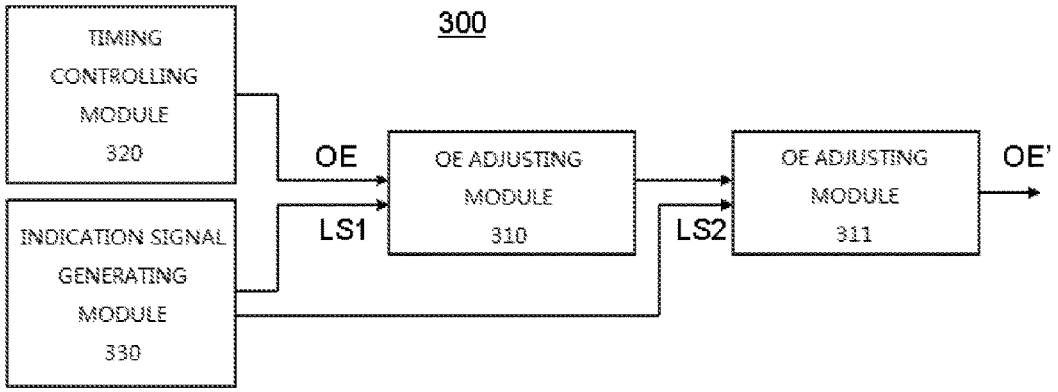
FIG. 7 schematically illustrates a display panel driving circuit including two output enable pulse adjusting modules according to an embodiment of the present disclosure.

FIG. 7 schematically illustrates a display panel driving circuit 300 including two OE adjusting modules 310, 311, according to an embodiment of the present disclosure.

Each of the OE adjusting modules 310, 311 may be implemented with the signal adjusting circuit 100 as shown in FIG. 4. In this case, the OE adjusting modules 310 and 311 are cascaded together by connecting the output terminal of the OE adjusting module 310 to the input terminal of the OE adjusting module 311.

Similar to the example of FIG. 5, the driving circuit 300 further includes a timing controlling module 320 and an indication signal generating module 330. The timing controlling module 320 provides periodic output enable pulses OE to the input terminal of the OE adjusting module 310 that is the first stage. The indication signal generating module 330 provides respective indication signals LS1 and LS2 to the OE adjusting modules 310 and 311, respectively. The OE adjusting module 311 outputs the adjusted output enable pulses OE'.

Figure 8:
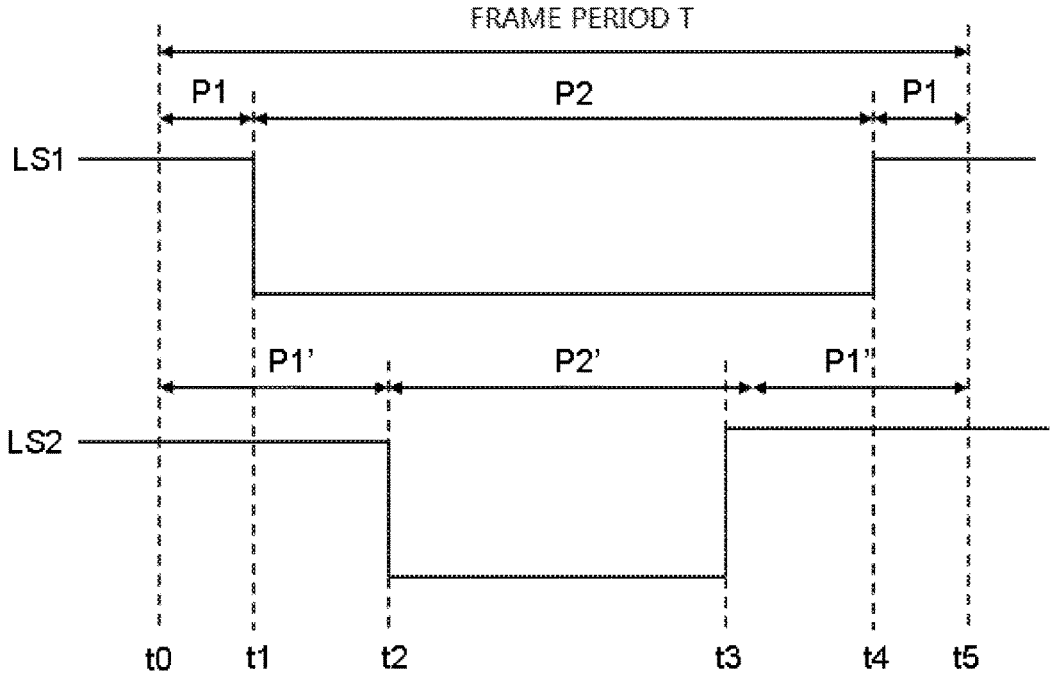
FIG. 8 schematically illustrates the timing of indication signals provided respectively to the two output enable pulse adjusting modules of the driving circuit as shown in FIG. 7.

FIG. 8 schematically illustrates the timing of indication signals LS1 and LS2 that are provided respectively to the two OE adjusting modules 310, 311 of the driving circuit 300 as shown in FIG. 7.

As shown in the figure, the indication signal LS1 includes a first phase P1 indicating not to delay the output enable pulses OE and a second phase P2 indicating to delay the output enable pulses OE, and the indication signal LS2 includes a first phase P1' indicating not to delay the output enable pulses OE and a second phase P2' indicating to delay the output enable pulses OE.

The second phase P2' of the indication signal LS2 may fall within the second phase P2 of the indication signal LS1 so that a duration of the second phase P2' of the indication signal LS2 may be smaller than a duration of the second phase P2 of the indication signal LS1. In this way, the output enable pulses OE in different time periods within a frame period T may be respectively delayed by different amounts of time. For example, in the examples as shown in FIGS. 7 and 8, assume that the delay time contributed by the OE adjusting module 310 is d1 and the delay time contributed by the OE adjusting module 311 is d2, the OE pulses input from time t0 to t1 and from time t4 to t5 are not delayed, OE pulses input from time t1 to t2 and from time t3 to t4 are delayed by d1, and OE pulses input from t2 to t3 are delayed by d1+d2. Thereby, finer control of the delay of the gate scan pulses may be provided.

It should be appreciated that although in the above examples the driving circuit 300 is described as including two OE adjusting modules, more OE adjusting modules are also possible.

While several specific implementation details are contained in the above discussions, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations are to be performed in the particular order shown or in a sequential order, or that all illustrated operations are to be performed to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Various modifications, adaptations to the foregoing exemplary embodiments of this disclosure may become apparent to those skilled in the relevant arts in view of the foregoing description, when read in conjunction with the accompanying drawings. Any and all modifications will still fall within the scope of the non-limiting and exemplary embodiments of this disclosure. Furthermore, other embodiments of the disclosure set forth herein will come to mind to one skilled in the art to which these embodiments of the disclosure pertain having the benefit of the teachings presented in the foregoing descriptions and the associated drawings.

Therefore, it is to be understood that the embodiments of the disclosure are not to be limited to the specific embodiments disclosed and that modifications and other embodiments are intended to be included within the scope of the appended claims. Although specific terms are used herein, they are used in a generic and descriptive sense only and not for purposes of limitation.

What is claimed is:

1. A signal adjusting circuit, comprising:

an input terminal for receiving an input signal;

a control terminal for receiving an indication signal;

an output terminal for outputting an adjusted input signal;

a selection module; and a delay module, wherein the selection module is connected to the input terminal, the control terminal, the output terminal and the delay module, and is operable to selectively transfer the input signal received via the input terminal to the output terminal or the delay module depending on the indication signal received via the control terminal, wherein the selection module comprises: a comparator having a first internal input terminal connected to the control terminal, a second internal input terminal for receiving a reference level, and an internal output terminal; a first transistor having a gate connected to the internal output terminal, a first electrode connected to the input terminal, and a second electrode connected to the output terminal; and a second transistor having a gate connected to the internal output terminal, a first electrode connected to the delay module, and a second electrode connected to the input terminal, wherein the first transistor is one of a P-type transistor and an N-type transistor, and the second transistor is of a type opposite to that of the first transistor; and wherein the delay module is connected to the selection module and the output terminal, and is operable to delay the input signal received from the selection module by an amount of time and transfer the delayed input signal to the output terminal.

2. The circuit according to claim 1, wherein the comparator comprises an integrated operational amplifier.

3. A display panel driving circuit, comprising:

one or more signal adjusting circuits as recited in claim 2, the one or more signal adjusting circuits being cascaded together so that the output terminal of a preceding signal adjusting circuit is connected to the input terminal of a succeeding signal adjusting circuit;

a timing control module for providing periodic output enable pulses to the input terminal of the first one of the one or more cascaded signal adjusting circuits, each of the output enable pulses being for enabling outputting of a respective gate scan pulse; and an indication signal generating module for providing the control terminal of each of the one or more cascaded signal adjusting circuits with a respective indication signal;

wherein each of the one or more cascaded signal adjusting circuits is configured to selectively delay the output enable pulses received via its input terminal by a respective amount of time depending on the respective indication signal.

4. The circuit according to claim 1, wherein the delay module comprises an RC delay circuit.

5. The circuit according to claim 4, wherein the delay module further comprises a waveform adjusting circuit connected in series with the RC delay circuit.

6. The circuit according to claim 5, wherein the waveform adjusting circuit comprises an edge trigger or an even number of phase inverters.

7. A display panel driving circuit, comprising:

one or more signal adjusting circuits as recited in claim 6, the one or more signal adjusting circuits being cascaded together so that the output terminal of a preceding signal adjusting circuit is connected to the input terminal of a succeeding signal adjusting circuit;

a timing control module for providing periodic output enable pulses to the input terminal of the first one of the one or more cascaded signal adjusting circuits, each of the output enable pulses being for enabling outputting of a respective gate scan pulse; and an indication signal generating module for providing the control terminal of each of the one or more cascaded signal adjusting circuits with a respective indication signal;

wherein each of the one or more cascaded signal adjusting circuits is configured to selectively delay the output enable pulses received via its input terminal by a respective amount of time depending on the respective indication signal.

8. A display panel driving circuit, comprising:

one or more signal adjusting circuits as recited in claim 5, the one or more signal adjusting circuits being cascaded together so that the output terminal of a preceding signal adjusting circuit is connected to the input terminal of a succeeding signal adjusting circuit;

a timing control module for providing periodic output enable pulses to the input terminal of the first one of the one or more cascaded signal adjusting circuits, each of the output enable pulses being for enabling outputting of a respective gate scan pulse; and an indication signal generating module for providing the control terminal of each of the one or more cascaded signal adjusting circuits with a respective indication signal;

wherein each of the one or more cascaded signal adjusting circuits is configured to selectively delay the output enable pulses received via its input terminal by a respective amount of time depending on the respective indication signal.

9. A display panel driving circuit, comprising:

one or more signal adjusting circuits as recited in claim 4, the one or more signal adjusting circuits being cascaded together so that the output terminal of a preceding signal adjusting circuit is connected to the input terminal of a succeeding signal adjusting circuit;

a timing control module for providing periodic output enable pulses to the input terminal of the first one of the one or more cascaded signal adjusting circuits, each of the output enable pulses being for enabling outputting of a respective gate scan pulse; and an indication signal generating module for providing the control terminal of each of the one or more cascaded signal adjusting circuits with a respective indication signal;

wherein each of the one or more cascaded signal adjusting circuits is configured to selectively delay the output enable pulses received via its input terminal by a respective amount of time depending on the respective indication signal.

10. The circuit according to claim 1, further comprising an output capacitor having a terminal connected to the output terminal and another terminal being grounded.

11. A display panel driving circuit, comprising:

one or more signal adjusting circuits as recited in claim 10, the one or more signal adjusting circuits being cascaded together so that the output terminal of a preceding signal adjusting circuit is connected to the input terminal of a succeeding signal adjusting circuit;

a timing control module for providing periodic output enable pulses to the input terminal of the first one of the one or more cascaded signal adjusting circuits, each of the output enable pulses being for enabling outputting of a respective gate scan pulse; and an indication signal generating module for providing the control terminal of each of the one or more cascaded signal adjusting circuits with a respective indication signal;

wherein each of the one or more cascaded signal adjusting circuits is configured to selectively delay the output enable pulses received via its input terminal by a respective amount of time depending on the respective indication signal.

12. The driving circuit according to claim 11, wherein the indication signal comprises within a frame period, a first phase indicating not to delay the output enable pulses, and a second phase indicating to delay the output enable pulses.

13. The driving circuit according to claim 12, wherein the first phase corresponds to a phase in which gate lines connected to wirings in an edge area of a fan-out region of a gate driver are scanned, and wherein the second phase corresponds to a phase in which gate lines connected to wirings in a non-edge area of the fan-out region of the gate driver are scanned.

14. A display panel driving circuit, comprising:

one or more signal adjusting circuits as recited in claim 1, the one or more signal adjusting circuits being cascaded together so that the output terminal of a preceding signal adjusting circuit is connected to the input terminal of a succeeding signal adjusting circuit;

a timing control module for providing periodic output enable pulses to the input terminal of the first one of the one or more cascaded signal adjusting circuits, each of the output enable pulses being for enabling outputting of a respective gate scan pulse; and an indication signal generating module for providing the control terminal of each of the one or more cascaded signal adjusting circuits with a respective indication signal;

wherein each of the one or more cascaded signal adjusting circuits is configured to selectively delay the output enable pulses received via its input terminal by a respective amount of time depending on the respective indication signal.

15. The driving circuit according to claim 14, wherein the indication signal comprises within a frame period, a first phase indicating not to delay the output enable pulses, and a second phase indicating to delay the output enable pulses.

16. The driving circuit according to claim 15, wherein the first phase corresponds to a phase in which gate lines connected to wirings in an edge area of a fan-out region of a gate driver are scanned, and wherein the second phase corresponds to a phase in which gate lines connected to wirings in a non-edge area of the fan-out region of the gate driver are scanned.

17. The driving circuit according to claim 15, wherein the second phase of the indication signal for a succeeding signal adjusting circuit falls within the second phase of the indication signal for a preceding signal adjusting circuit so that a duration of the second phase of the indication signal for the succeeding signal adjusting circuit is smaller than a duration of the second phase of the indication signal for the preceding signal adjusting circuit.

18. The driving circuit according to claim 14, wherein the timing control module and the indication signal generating module are integrated in a timing controller of the display panel.

* * * * *